United States Patent [19]

Guimond et al.

[11] Patent Number: 4,938,707

[45] Date of Patent: Jul. 3, 1990

[54] MULTIMATE COAXIAL ADAPTER

[75] Inventors: Ronald Guimond, Amesbury; Anthony Martiniello, Wilmington, both of Mass.

[73] Assignee: Adams-Russell Electronic Company, Inc., Amesbury, Mass.

[21] Appl. No.: 324,183

[22] Filed: Mar. 16, 1989

[51] Int. Cl.[5] ..... H01R 17/18

[52] U.S. Cl. ..... 439/218; 439/578

[58] Field of Search ..... 439/166, 170, 171, 173, 439/174, 175, 217, 218, 222, 824, 151

[56] References Cited

U.S. PATENT DOCUMENTS

| | | | |
|---|---|---|---|
| 3,139,492 | 6/1964 | Cage, Jr. | 439/172 |
| 3,771,108 | 11/1973 | Haffner et al. | 439/364 |
| 3,856,375 | 12/1974 | Muench | 439/151 |
| 4,227,094 | 10/1980 | Semur et al. | 439/540 |
| 4,736,999 | 4/1988 | Marks et al. | 439/218 |
| 4,813,886 | 3/1989 | Roos et al. | 439/578 |

*Primary Examiner*—David Pirlot

*Attorney, Agent, or Firm*—St. Onge Steward Johnston & Reens

[57] ABSTRACT

A multimate coaxial adapter is described with which one type of coaxial connector can be conveniently terminated with one of several other types of connectors. A pair of axially separable and rotatable mating plates are provided with coaxial connectors on outer sides. The connectors are evenly spaced about an axis of rotation. The inside surfaces of the plates are provided with mating coaxial conduits that are electrically coupled to the connectors. A spring loaded mechanism is used to normally bias the plates towards each other while enabling their axial separation and rotation to obtain a desired alignment of connectors on different plates.

8 Claims, 5 Drawing Sheets

MULTIMATE COAXIAL ADAPTER

Field Of The Invention

This invention relates generally to coaxial adapters and more specifically to variable interseries coaxial adapters.

Background Of The Invention

Adapters capable of coupling in-coming coaxial cables to different types are known in the art; see, for example U.S. Pat. No. 2,432,476. Use of the adapter in this patent, however, limits the possible interconnections to those between a central coaxial connector and others that are radially disposed therefrom.

U.S. Pat. No. 3,139,492 discloses a respositionable multiple-pin connector in which certain pin positions be excluded. Desired electrical connections are obtained by axial separation and subsequent relative rotation of separable parts.

Summary Of The Invention

In a multimate adapter in accordance with the invention, an adaptor terminating with one type of connector interface such as an N or TNC series can be conveniently adapted to another series of connector. This is obtained in one form of the invention by providing outer sides of a pair of plates with various types of connectors that are likely to be needed and are arranged about an axis of rotation The inner sides of the plates are provided with coaxial conduits that are in respective electrical communication with the connectors. The plates are mounted so that the inner sides with the coaxial conduits face each other. The plates are normally biased towards each other and can be rotated as well as axially separated to select the desired coaxial adaption.

It is, therefore, an object of the invention to provide a multimate adapter by which a coaxial adapter terminating with one type of connector can be conveniently and quickly adapted to a different type of coaxial connector. It is a further object of the invention to provide a multimate adapter with good electrical characteristics.

These and other advantages and objects of the invention can be understood from the following detailed description of an embodiment as shown in the drawings.

Detailed Description of Drawings

Figure 1:
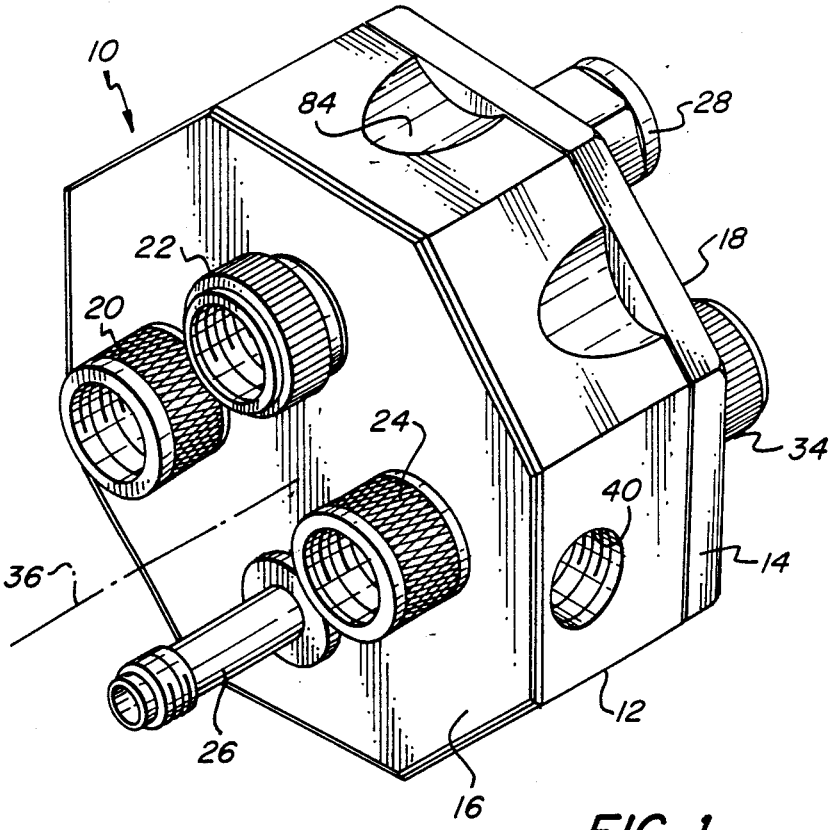
FIG. 1 is a perspective view of a multimate coaxial adapter in accordance with the invention.
Figure 2:
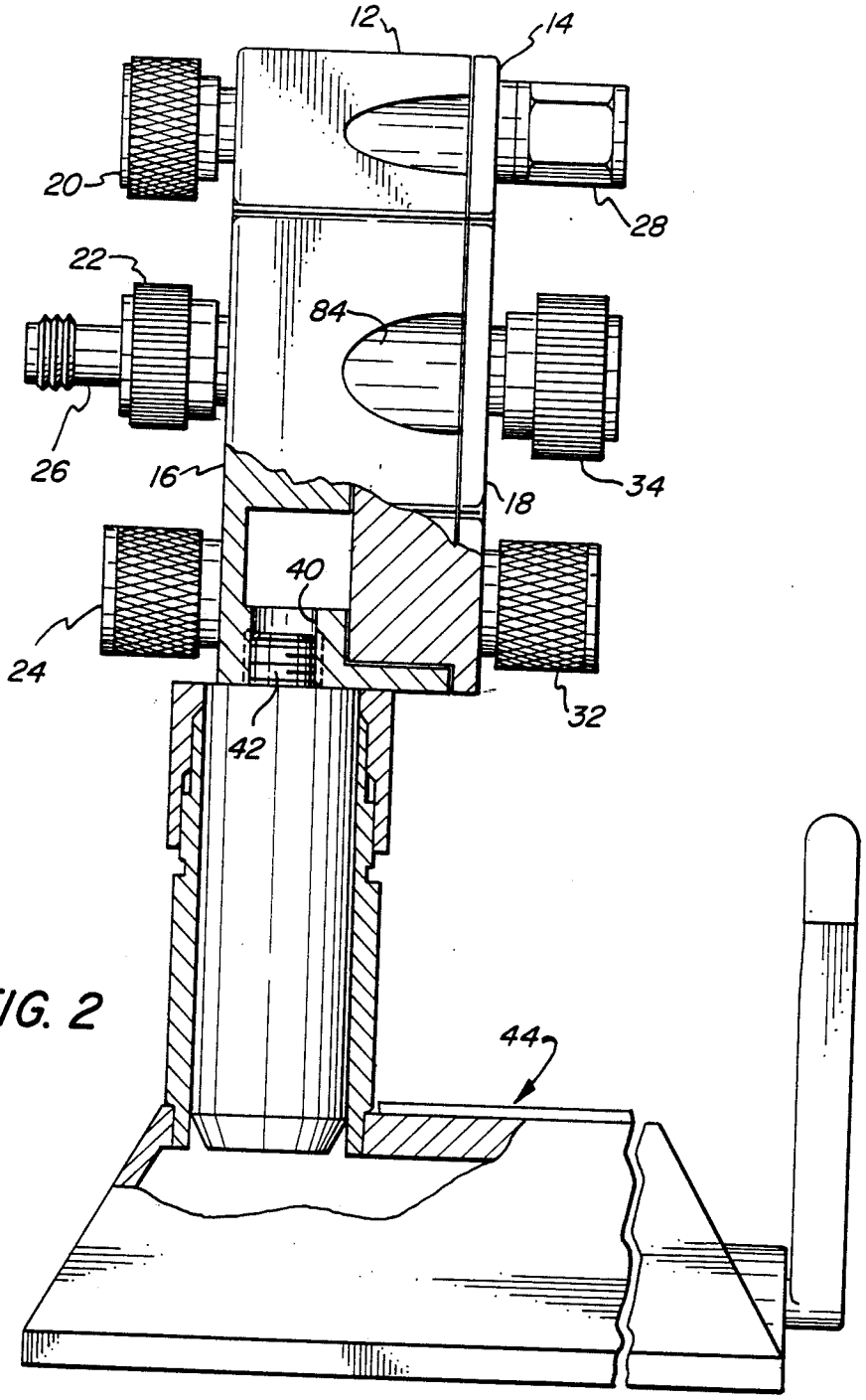
FIG. 2 is a side view in elevation partially in crossection of the multimate coaxial adapter of the invention as placed on a support mounting.

Referring to FIGS. 1 and 2, a multimate adapter 10 in accordance with the invention is shown. Variable multimate adapter 10 has a pair of normally-abutting plates 12 and 14. Each plate has a variety of different coaxial connectors on outer sides 16 and 18 respectively. Plates 12 and 14 have a variety of different coaxial connectors on sides 16 and 18 respectively. Plate 12 has a plurality of different coaxial connectors 20, 22, 24, and 26 and plate 14 has a like number of connectors 28, 30, 32 and 34 (see FIGS. 2, 5 and 7). These connectors 20–34 are evenly spaced from and around an axis of rotation 36. Plates 14 and 16 are axially separable and rotatable relative to each other about axis 36. The connectors can be of various types such as an APC-7 series connector, a male or female type TNC or type N or SMA as may appear desirable to provide various useful types of adapters.

Plate 12 is further provided with a threaded mounting hole 40, see FIG. 2, that is engaged by a complementary threaded stud 42 on a support mount 44. This enables a vertical mounting as illustrated.

With reference to FIGS. 3–8, the multimate adapter 10 has its plates 12, 14 mounted to each other with a central shaft 46 that has one threaded end 48 screwed to a threaded hole 50 in plate 12 and another threaded end 52 screwed into a threaded bore 54 of a cap 56. Plate 14 has a bore 58 through which shaft 46 extends and a counter bore 60 into which cap 56 can slide.

Cap 56 has a counter bore 63 to seat a spring 62. Spring 62 biases plate 12 and 14 together, yet enables their axial separation and subsequent rotation to align appropriate coaxial connectors on sides 16 and 18 of plates 12, 14.

Each plate 12 and 14 thus further is provided with mating coaxial conduits. Like female conduits 66 are located on axial inner side 68 of plate 12 and like male coaxial conduits 70 are on axial inner side 72 of plate 14. These conduits 66 and 70 are coaxially connected to respective axially aligned connectors on the other sides 16, 18 of plates 12, 14 using precision low VSWR coaxial connections.

Figure 4:
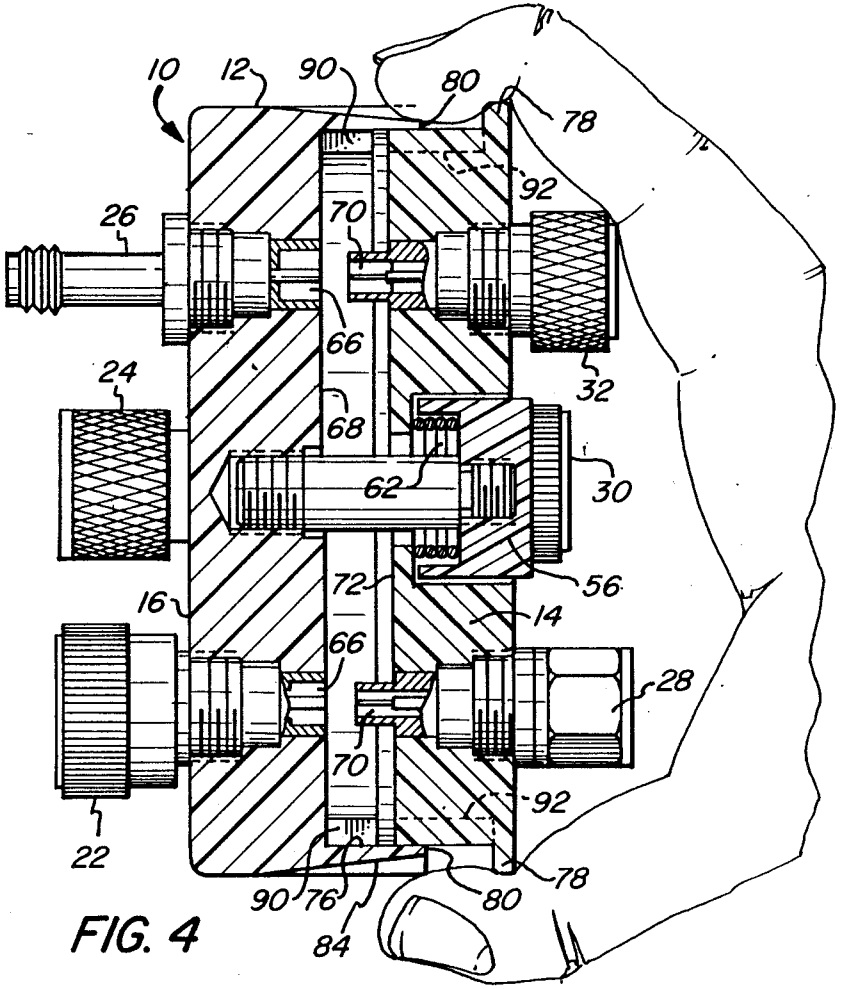
FIG. 4 is a side cross-section as in FIG. 3 with separated plates to enable selection of a coaxial connection.
Figure 3:
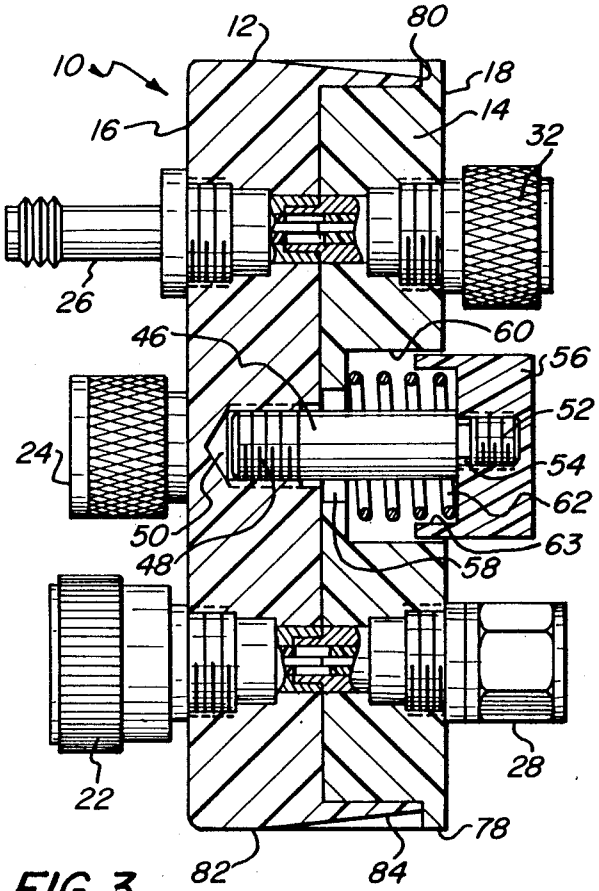
FIG. 3 is a side sectional view of the multimate coaxial adapter.

Plate 12 has a wide counter bore 76 sized to receive plate 14 which has a peripheral lip 78 to seat rim 80 of plate 12. The radial peripheral surface 82 of rim 80 has a plurality of indentations 84 that increase in depth towards peripheral lip 78. These indentations enable one to grip plate 14 as shown in FIG. 4 to axially-separate the plates when this is required.

Figure 5:
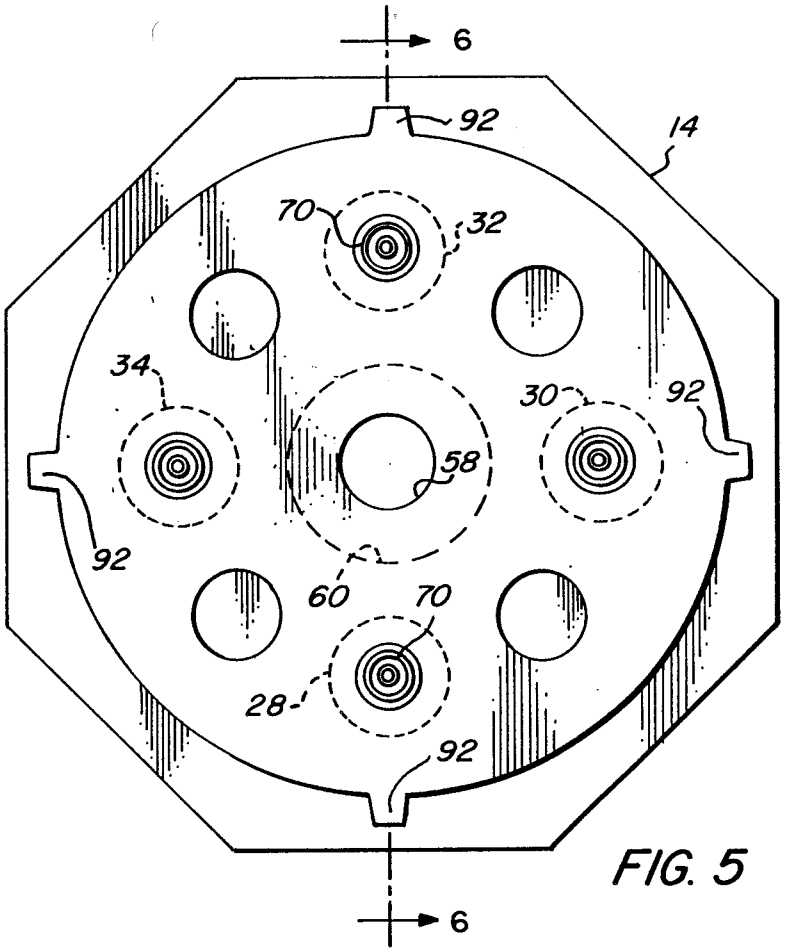
FIG. 5 is a front view of one plate used in the multimate adapter of FIG. 1.
Figure 6:
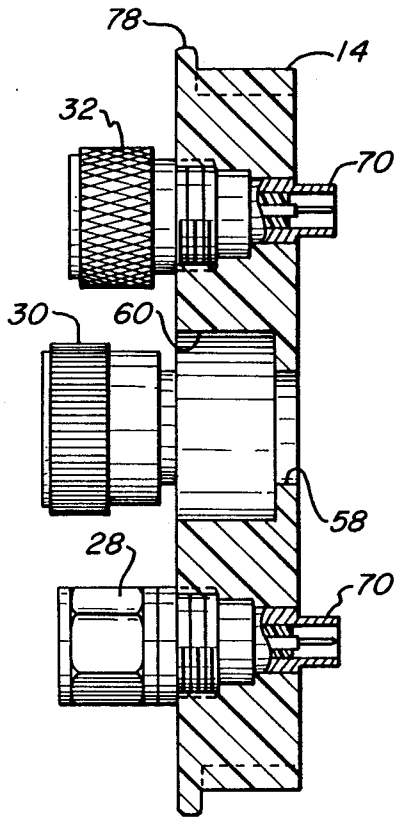
FIG. 6 is a section view taken along the line 6—6 in FIG. 5.
Figure 7:
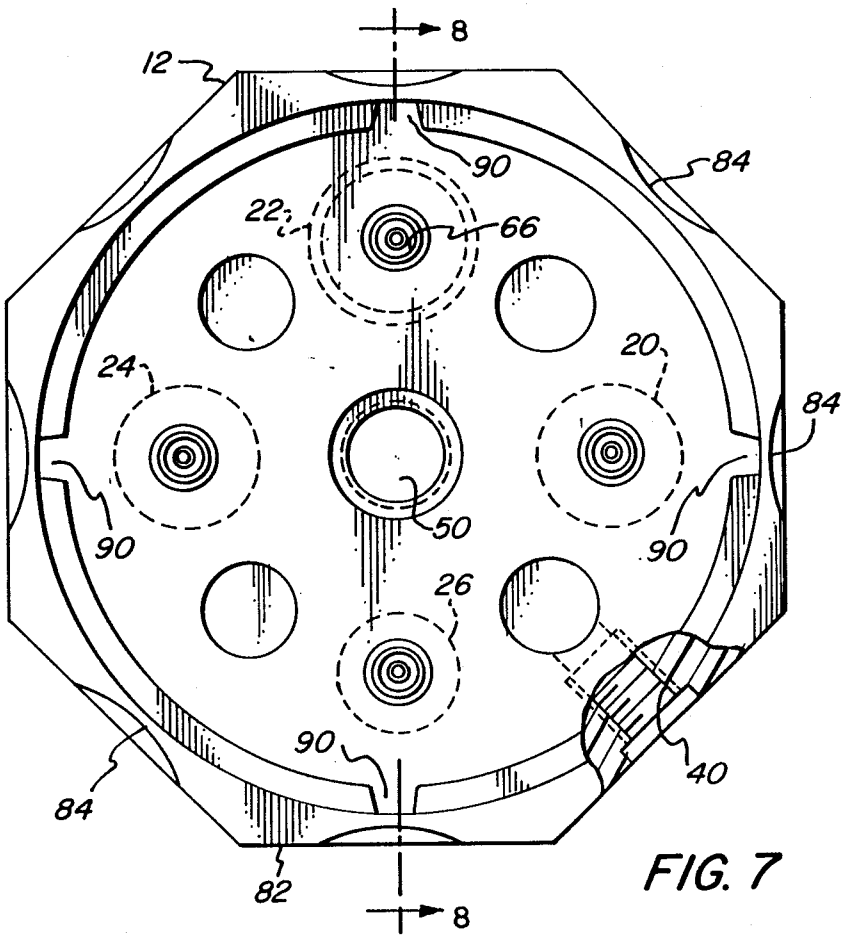
FIG. 7 is a front view of another mating plate used in the multimate adapter of FIG. 1.
Figure 8:
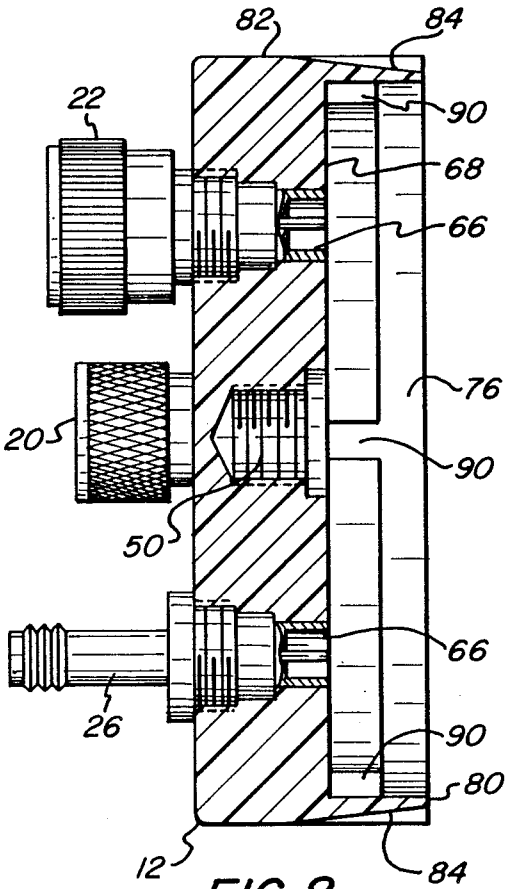
FIG. 8 is a section view taken along the line 8—8 in FIG. 7.

Appropriate rotational alignment of conduits 66 and 70 is sensed with a plurality of circumferentially distributed axially oriented key segments 92 on plate 14 (see FIGS. 4 and 5) that fit and slide into correspondingly sized axially oriented notches 90 in plate 12. The key segments 92 could be pins and the notches 90 could be corresponding holes. As shown in FIGS. 5 and 7, four of these key segments 92 and notches 90 are used at peripheral locations of the plates 12, 14 to provide an alignment for four different coaxial adaptations. More adaptations would be accompanied with correspondingly additional key segments 92 and notches 90 to provide corresponding rotational adaptation positions.

Variations of the coaxial adaptations can be accomplished by axially-separating plates 12, 14 and thus also disengaging conduits 66, 70 and subsequently rotating plates 12 and 14 relative to each other. Conduits 66, 70 will neither abut nor engage until the key segments 92 align and slide into notches 90. A meshing of the key segments and the notches results in an abutment of plates 12, 14 with an engagement of the conduits to thus provide the desired coaxial adaptation.

Having thus described a multimate coaxial adapter in accordance with the invention, its advantages can be understood. Variations from the described embodiment can be made without departing from the scope of the invention as determined from the following claims.

What is claimed is:

1. A multimate adapter comprising:

a first plate having on an outer side a plurality of various first coaxial connectors radially spaced from an axis of rotation;

a second plate having on an outer side a plurality of various second coaxial connectors that are radially spaced from an axis of rotation;

coaxial conduits on inner sides of the first and second plates and distributed about the axes of rotation at the same distance therefrom, said conduits being coupled to respective coaxial connectors and terminating on the outer sides of the first and second plates, the conduits on the first plate operatively interfitting with the conduits on the second plate so as to enable the transfer of microwave energy from any one of the plurality of first coaxial connectors to any one of the plurality of second coaxial connectors when respective ones of the coaxial conduits are placed to operatively interfit with each other; and means for axially and rotationally moveably mounting said plates with respect to each other and with their inner sides facing and being spring biased towards each other and with their respective axes of rotation in alignment so as to enable operative axial engagement of aligned coaxial conduits while enabling axial separation against the spring bias of the first and second plates to rotate a coaxial conduit that is coupled to a first coaxial connector into alignment with a coaxial conduit that is coupled to a second coaxial connector.

2. The multimate adapter as claimed in claim 1 wherein the first plate has a peripheral rim and wherein the second plate has, on its outer side a peripheral edge located to be opposite an axial end of said peripheral rim, said peripheral rim having a plurality of indentations distributed about the axis of rotation, said indentations being sized to enable a manual gripping of the peripheral edge for axial separation and rotation of the first and second plates relative to each other.

3. The multimate adapter as claimed in claim 1 wherein said one plate has a radially extending threaded bore; and a mount assembly having a projecting threaded stud extending therefrom for attachment into the radially extending threaded bore for supporting the multimate adapter.

4. The multimate adapter as claimed in claim 1 wherein said mounting means includes:

a coaxially-located bore extending through said first plate and a coaxial counter bore therein that terminates at a first shoulder;

a coaxially-located shaft connected to the second plate and extending through the bore and into the counter bore in said first plate;

a cap on the shaft and sized to slide within the counter bore and having a second shoulder opposite the first shoulder; and a spring seated on the first and second shoulders to urge the first and second plates towards each other.

5. The multimate adapter as claimed in claim 4 wherein said cap includes a counter bore sized to receive the shaft and the spring; said cap having a threaded central bore, and with said shaft having a threaded end that screws into the threaded central bore.

6. The multimate adapter as claimed in claim 1 wherein one plate has, on its inner side, a plurality of key segments and the other plate has, on its inner side, a plurality of notches sized to receive the key segments, said key segments and notches being so distributed as to provide an alignment of the plates for their respective rotational adaptation positions.

7. The multimate adapter as claimed in claim 6 wherein said key segments and notches are disposed near peripheral parts of the plates.

8. The multimate adapter as claimed in claim 7 wherein the number of keY segments and the number of notches correspond with the number of connectors on a plate.

* * * * *